United States Patent [19]

Anthony

[11] 4,050,042

[45] Sept. 20, 1977

[54] STATIC CONVERGENCE DEVICES FOR COLOR TELEVISION PICTURE TUBES

[75] Inventor: Albert M. Anthony, Bangor, Mich.

[73] Assignee: Tracor, Inc., Austin, Tex.

[21] Appl. No.: 732,101

[22] Filed: Oct. 13, 1976

[51] Int. Cl.[2] ..... H01J 29/68

[52] U.S. Cl. ..... 335/212; 358/249

[58] Field of Search ..... 335/210, 211, 212; 358/248, 249; 313/433, 438

[56] References Cited

U.S. PATENT DOCUMENTS

| | | | |
|---|---|---|---|
| 2,525,919 | 10/1950 | Loughren | 335/212 UX |
| 3,330,979 | 7/1967 | Constantine | 335/212 X |
| 3,646,669 | 3/1972 | Erickson | 335/212 X |
| 3,898,597 | 8/1975 | Vonk | 335/212 |
| 3,902,145 | 8/1975 | Slavenburg et al. | 335/212 |

*Primary Examiner*—A. D. Pellinen

*Attorney, Agent, or Firm*—Burmeister, York, Palmatier, Hamby & Jones

[57] ABSTRACT

Each disclosed convergence device is particularly adapted for converging the three electron beams of an in-line picture tube. Each convergence device comprises a mounting sleeve having an axial opening for receiving the neck of the picture tube, and a plurality of beam adjusting assemblies mounted around the supporting sleeve. Each beam adjusting assembly may comprise a rotatable supporting ring, a pair of rotatable magnet rings stacked upon the mounting ring, the magnet rings having integral bevel gears facing toward each other, a radial shaft having a bevel pinion meshing with such gears, and a member on the supporting ring and rotatably supporting the shaft. Each magnet ring is formed with permanent magnetic poles. The orientation of the poles can be varied by rotating the entire beam adjusting assembly about the axis of the picture tube. The effective strength of the poles can be adjusted by rotating the shaft, which causes rotation of the magnet rings in opposite directions. In one embodiment, there are two such beam adjusting assemblies, plus a third similar assembly in which the supporting ring is replaced by a flange on the mounting sleeve. In a second embodiment, there are three of the rotatable beam adjusting assemblies, which are stacked and pressed together by springs. A clamping device produces increased clamping pressure between the adjusting assemblies to retain the adjustment thereof.

17 Claims, 28 Drawing Figures

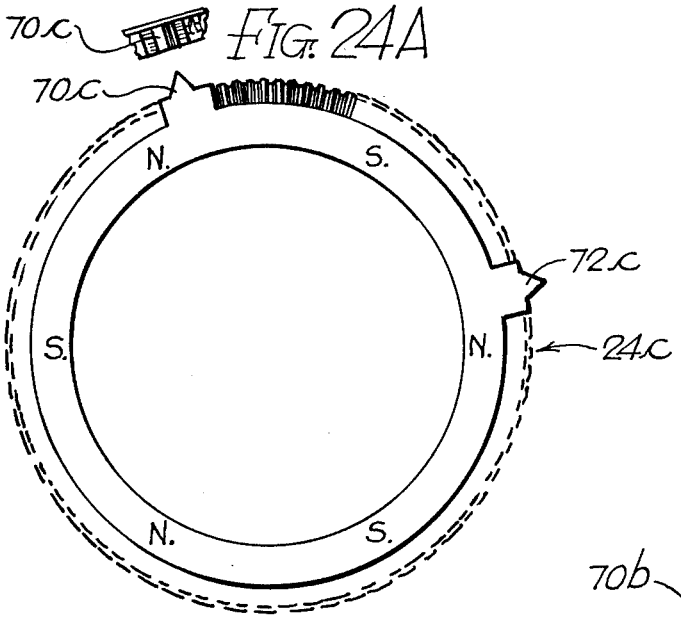
FIG. 24A
FIG. 24
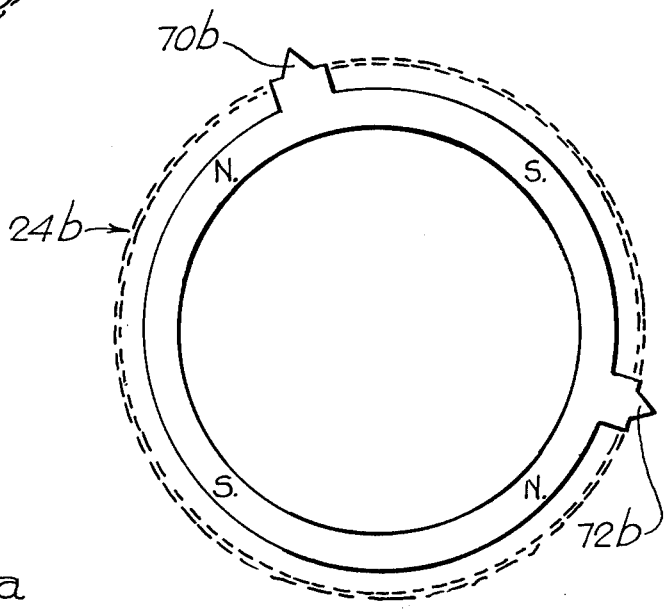
FIG. 23
FIG. 25
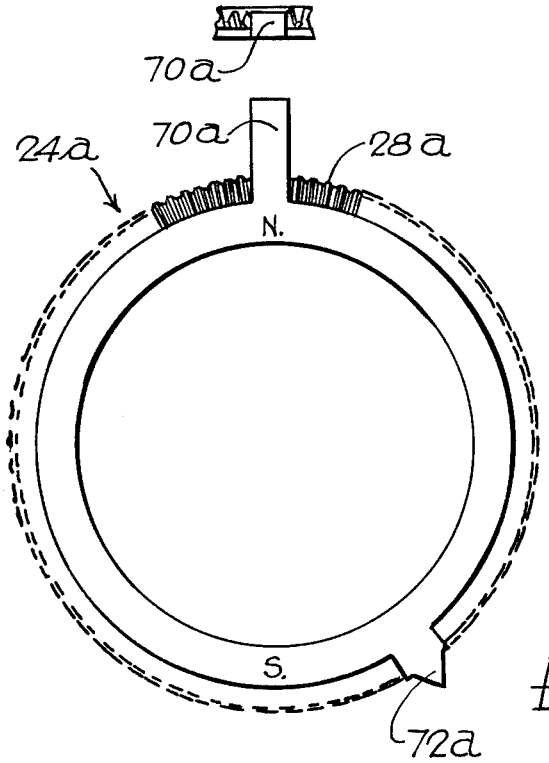
FIG. 22

STATIC CONVERGENCE DEVICES FOR COLOR TELEVISION PICTURE TUBES

This invention relates to static convergence devices for initially converging the three electron beams of a color television picture tube, particularly a tube of the type having three in-line beams.

One object of the present invention is to provide a new and improved convergence device of the type utilizing movable beam adjusting members having permanent magnet poles to produce adjustable magnetic fields for bending the beams and thereby converging them.

A further object is to provide a new and improved convergence device having a plurality of beam adjusting assemblies, each of which can be adjusted very easily and quickly to change both the orientation and the effective strength of the magnetic fields produced by the magnet poles.

In accordance with the present invention, the static convergence device may comprise a supporting sleeve having an axial opening for receiving the neck of a color television picture tube, and at least one beam adjusting assembly mounted around such sleeve. Three such adjusting assemblies are preferably provided. Each beam adjusting assembly may comprise a supporting ring around the mounting sleeve, a pair of rotatable magnet rings stacked upon the supporting ring and having integral bevel gears facing toward each other, a radial shaft having a bevel pinion meshing with both bevel gears and preferably held captive therebetween, and a member on the supporting ring and having means for rotatably supporting the shaft for rotation about a radial axis.

In one embodiment, one of the beam adjusting assemblies has a supporting ring which is formed integrally with the mounting sleeve as a flange thereon. The other two beam adjusting assemblies include supporting rings which are rotatable about the mounting sleeve.

In another embodiment, all three of the beam adjusting assemblies include supporting rings which are rotatable about the mounting sleeve.

The beam adjusting assemblies are retained in a stack and are preferably pressed together by springs. A clamping device is preferably provided for producing increased clamping pressure upon the beam adjusting assemblies to hold them in their adjusted positions.

Further objects, advantages and features of the present invention will appear from the following description, taken with the accompanying drawings, in which:

FIG. 22 is an enlarged end view of one of the two-pole magnet rings.

FIG. 23 is an enlarged end view of one of the four-pole magnet rings.

FIG. 24 is an enlarged end view of one of the six-pole magnet rings.

FIG. 24A is a fragmentary auxiliary view showing one of the stops on the magnet ring of FIG. 24.

FIG. 25 is a fragmentary auxiliary view showing a stop tab on the magnet ring of FIG. 22.

As just indicated, FIGS. 1–4 of the drawings illustrate an illustrative embodiment of the present invention, in the form of a static convergence device 10, adapted to be mounted around the neck 12 of a color television picture tube, particularly of the type having three in-line electron beams 14R, G and B, where R, G and B stand for the colors red, green and blue, produced by the electron beams on the screen of the picture tube. The purpose of the convergence device 10 is to converge all three beams initially on the desired spot. This is done by producing variable magnetic fields to bend the three beams.

Figures 1, 2, 3, 4, 4A:
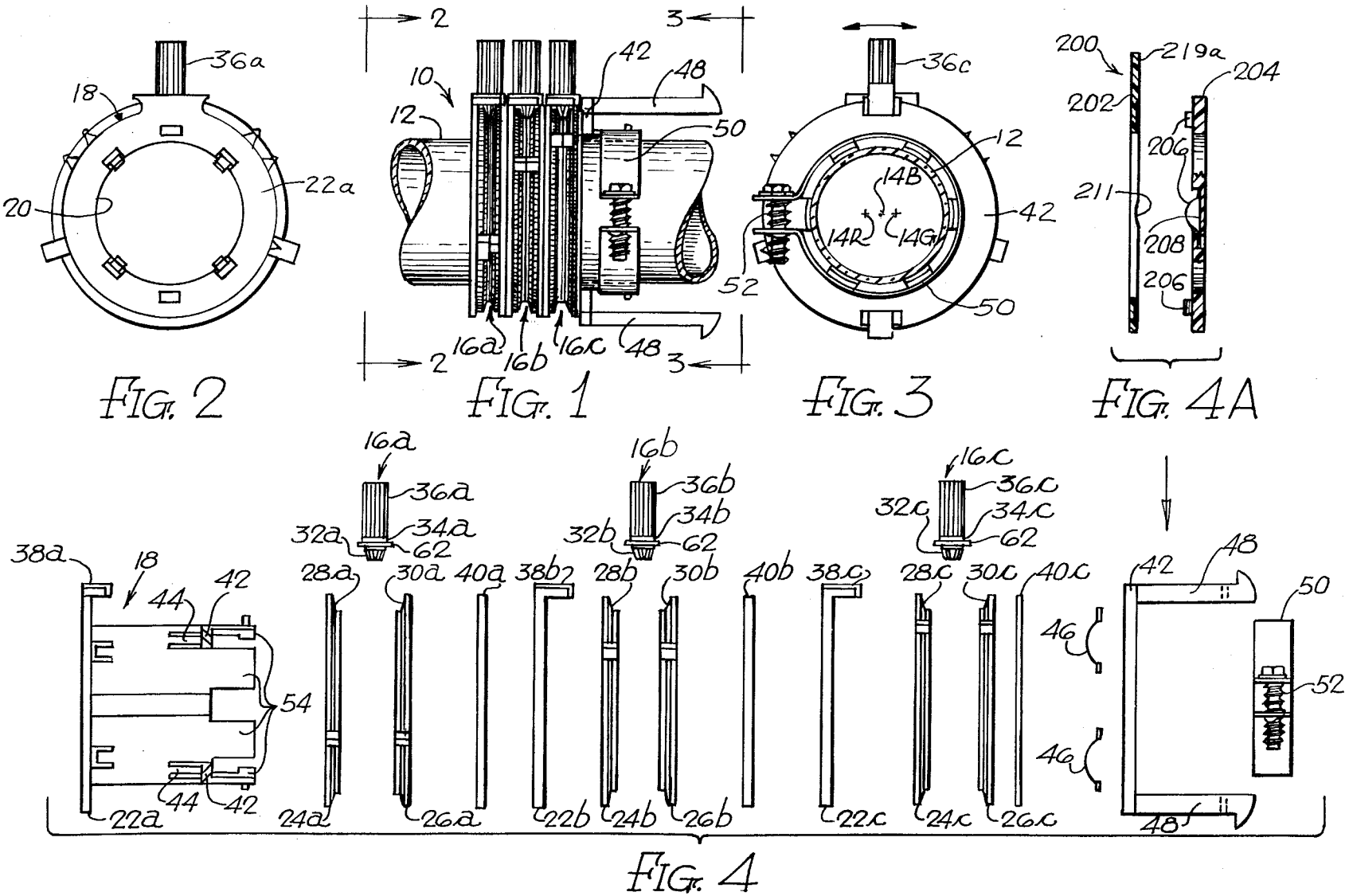
FIG. 1 is a side elevational view of a static convergence device to be described as one illustrative embodiment of the present invention.
FIGS. 2 and 3 are end views taken from the opposite ends of the convergence device of FIG. 1.
FIG. 4 is an exploded side elevational view of the convergence device of FIG. 1, showing the disassembled components of the device.
FIG. 4A is an exploded sectional view corresponding to a portion of FIG. 4 and illustrating a clamping device which may be incorporated into the convergence of FIG. 4.

The illustrated convergence device 10 comprises three beam adjusting assemblies or units 16*a, b* and *c* which are supported by a supporting sleeve 18, shown to best advantage in FIG. 4. The supporting sleeve 18 has an axial opening 20 for receiving the neck 12 of the picture tube.

In this case, the first beam adjusting assembly 16*a* is slightly different mechanically from the other two beam adjusting units 16*b* and *c*, which are the same mechanically. The beam adjusting unit 16*a* comprises a supporting ring 22*a*, which in this case is in the form of a ring-shaped flange formed integrally with the supporting sleeve 18. Magnet rings 24*a* and 26*a* are rotatably mounted around the supporting sleeve 18 and are stacked upon the supporting ring 22*a*. Bevel gears 28*a* and 30*a* are formed in one piece with the magnet rings 24*a* and 26*a*, respectively, and are oriented so as to face each other. The bevel gears 28*a* and 30*a* mesh with the opposite sides of a pinion gear 32*a* formed on a rotatable adjusting shaft 34*a* which has a manually operable knob portion 36*a*. The shaft 34*a* is rotatably supported by a member 38*a* on the supporting ring 22*a*. The shaft 34*a* is supported for rotation about a radial axis. When the shaft 34*a* is rotated, the magnet rings 24*a* and 26*a* are rotated in opposite directions.

The beam adjusting assemblies 16*b* and 16*c* are the same mechanically. Each of them comprises a supporting ring 22*b/c* which is rotatably supported on the supporting sleeve 18. Rotatable magnet rings 24*b/c* and 26*b/c*, similar to the magnet rings 24*a* and 26*a*, are stacked against the supporting ring 22*b/c*. As before, the magnet rings 24*b/c* and 26*b/c* are formed with integral bevel gears 28*b/c* and 30*b/c* which mesh with the opposite sides of a bevel pinion 32*b/c* on a rotatable shaft 34*b/c* having a manually rotatable knob portion 36*b/c*. The shaft 34*b/c* is rotatably supported by a member 38*b/c* on the supporting ring 22*b/c*.

The beam adjusting assemblies 16*a, b* and *c* are stacked upon the supporting sleeve 18. To facilitate the independent adjustment of the three assemblies, a washer 40*a* is interposed between the magnet ring 26*a* and the second supporting ring 22*b*. Similarly, a washer 40*b* is interposed between the magnet ring 26*b* and the third supporting ring 22*c*. A third washer 40*c* is stacked against the magnet ring 26*c*.

The beam adjusting assemblies 16*a, b* and *c* are retained on the supporting sleeve 18 by retaining means, which may comprise a retaining ring 42, received around the supporting sleeve 18 and retained thereon by a plurality of barbs or catches 42, formed on resilient spring fingers 44. One or more springs 46 are preferably provided to press the stacked beam adjusting assemblies 16*a, b* and *c* together. As shown, the springs 46 are in the form of a plurality of bow springs compressed between the retainer ring 42 and the washer 40*c*. The illustrated retainer ring 42 has a pair of bracket arms 48, which, however, can be omitted, if not needed to support other components.

The illustrated convergence device 10 includes a ring clamp 50 for clamping the supporting sleeve 18 around the neck 12 of the picture tube. The ring clamp 50 includes an adjustable clamping screw 52. It will be seen that the ring clamp 50 encircles a plurality of clamping fingers 54, formed on one end of the supporting sleeve 18, the other end being formed with the supporting ring 22*a*.

As shown to best advantage in FIGS. 11–21 each of the rotatable adjusting shafts 34*a, b* and *c* is preferably received in a generally U-shaped bearing seat 60 (FIGS. 16 and 18–21) formed in the corresponding supporting member 38*a, b* or *c*. It will be seen that each bearing seat 60 has an open side facing away from the corresponding supporting ring 22*a, b* or *c*.

Figures 5, 6, 7, 8, 9, 9A, 10, 10A, 11, 12, 13, 14:
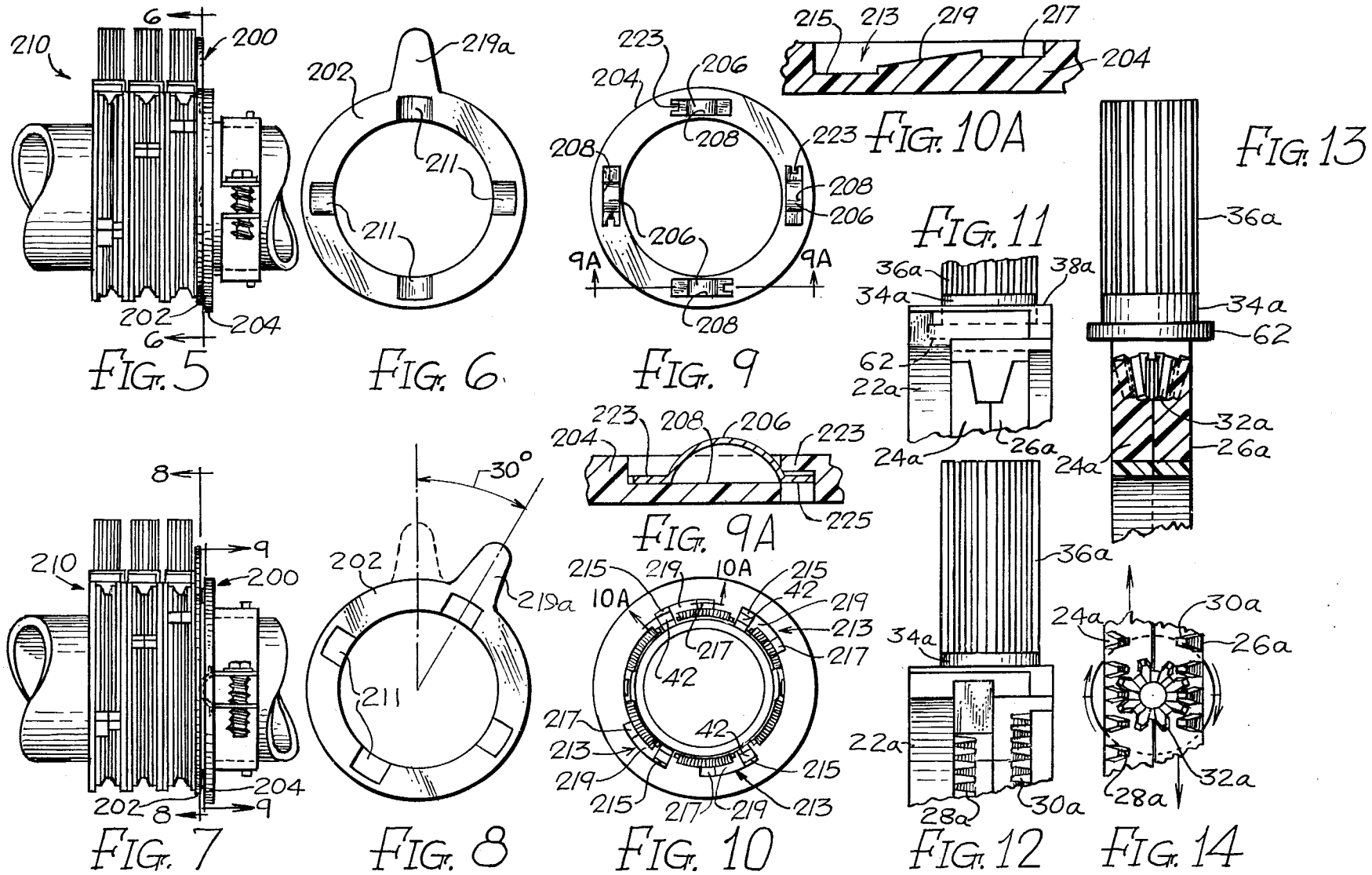
FIG. 5 is a side elevation, similar to FIG. 1, but showing a modified convergence device which incorporates the clamping device of FIG. 4A, the clamping device being shown in its released position.
FIG. 6 is an end view of an operating ring employed as one component of the clamping device, the view being taken generally as indicated by the line 6—6 in FIG. 5.
FIG. 7 is an elevation similar to FIG. 5, but showing the clamping device in its actuated position.
FIG. 8 is an end view of the operating ring in its actuated position, the view being taken generally as indicated by the line 8—8 in FIG. 7.
FIG. 9 is an end view of a spring supporting ring, also employed as a component of the clamping device, the view being taken as indicated by the line 9—9 in FIG. 7.
FIG. 9A is a fragmentary enlarged section taken generally along the line 9A—9A in FIG. 9.
FIG. 10 is an end view of the convergence device of FIG. 7, showing the opposite side of the spring supporting ring.
FIG. 10A is a fragmentary enlarged diagrammatic section, taken generally along the line 10A—10A in FIG. 10.
FIG. 11 is a fragmentary enlarged diagrammatic elevation of one of the beam adjusting assemblies for the embodiments of FIGS. 1–10.
FIG. 12 is a view similar to FIG. 11, but showing one of the stops on one of the magnet rings.
FIG. 13 is a fragmentary enlarged section taken through one of the beam adjusting assemblies, and showing the pinion gear meshing with the corresponding bevel gears.
FIG. 14 is a diagrammatic end view showing the pinion gear of FIG. 13.
Figure 16:
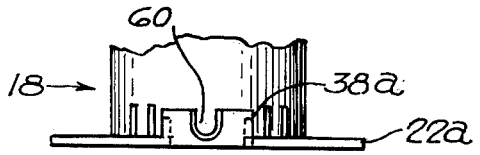
FIG. 16 is a fragmentary top view taken generally as indicated by the line 16—16 in FIG. 15.
Figure 15:
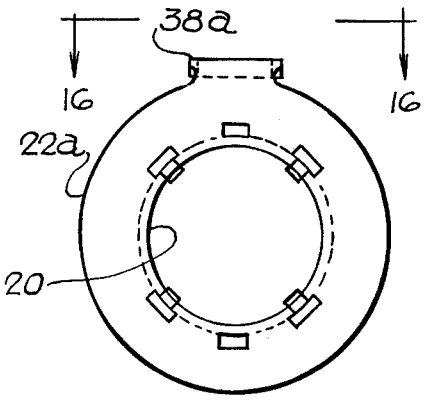
FIG. 15 is an enlarged left-hand view of the supporting sleeve of FIG. 4.

Flange means are preferably provided to retain the shafts 34*a, b* and *c* in the bearing seats 60 against radial movement. As shown in FIGS. 4 and 13, each of the shafts 34*a, b* and *c* is formed with an outwardly projecting ring-shaped flange 62, adapted to be received and held captive in a groove 64 (FIGS. 18–21) formed in the corresponding bearing seat 60.

When the convergence device 10 is fully assembled, each of the pinions 32*a, b* and *c* is held captive between the corresponding bevel gears 28*a, b* and *c* and 30*a, b* and *c*, so that each of the shafts 34*a, b* and *c* is retained in its bearing seat 60. The provision of the open-sided bearing seats 60 makes it easy to assemble the convergence device 10.

Each of the magnet rings 24*a, b, c* and 26*a, b, c* preferably has two outwardly projecting stops 70*a, b, c*, and 72*a, b, c*, which are engageable with the pertinent supporting member 38*a, b, c*. The stops establish the angular ranges through which the magnet rings 24*a, b, c* and 26*a, b, c* are rotatable.

As indicated in FIGS. 22, 23 and 24, the first pair of magnet rings 24*a* and 26*a* have two magnetic poles and are rotatable through approximately 180°. The poles are indicated as N and S in FIG. 22, standing for North and South.

The magnet rings 24*b* and 26*b* of the second pair have four magnetic poles, as indicated in FIG. 23, and are rotatable through approximately 90°.

The magnet rings 24*c* and 26*c* of the third pair have six magnetic poles, as indicated in FIG. 24, and are rotatable through approximately 60°.

The two-pole magnet rings 24*a* and 26*a* product a diametrical magnetic field which causes substantially equal bending of all three electron beams. The direction of the bending is determined by the angle to which the first beam adjusting assembly 16*a* is adjusted. In the convergence device 10 of FIGS. 1–4, this adjustment is made by turning the supporting sleeve 18 about the neck 12 of the television picture tube. The magnitude of the beam bending is varied by manually rotating the adjusting shaft 34*a*, so as to rotate the magnet rings 24*a* and 26*a* in opposite directions. The maximum beam bending is achieved when like magnetic poles on both rings 24*a* and 26*a* are aligned, north opposite north and south opposite south. The beam bending is substantially zero when unlike magnetic poles are aligned, north opposite south and south opposite north, so that the magnetic fields produced by the two magnet rings 24*a* and 26*a* substantially neutralize each other.

Inasmuch as the magnet rings 24*a* and 26*a* of the first beam adjusting assembly 16*a* cause substantially equal bending of the three electron beams, these rings provide a color purity adjustment. These rings adjust the position of the spot on which all three beams are converged initially.

The four poles of the second magnet rings 24*b* and 26*b* are substantially equally spaced around the rings. These magnet rings 24*b* and 26*b* produce a magnetic field which tends to bend the two outer electron beams in opposite directions, while having substantially no bending effect upon the central beam. The directions in which the outer beams are bent can be varied by rotating the second beam bending assembly 16*b* about the axis of the supporting sleeve 18. Such adjustment is effected by using the shaft 34*b* as a handle to rotate the supporting ring 22*b* about the supporting sleeve 18. The extent to which the outer electron beams are bent can be varied by rotating the adjusting shaft 34*b*, so as to rotate the magnet rings 24*b* and 26*b* in opposite directions. The maximum beam bending effect is achieved when like magnetic poles of the two rings 24*b* and 26*b* are aligned, north opposite north and south opposite south. The bending effect is substantially zero when the rings 24*b* and 26*b* are rotated so that unlike magnetic poles of the two rings are aligned, north opposite south and south opposite north. At intermediate positions of the magnet rings, the beam bending effect is between zero and the maximum amount.

In the third magnet rings 24*c* and 26*c*, the six magnetic poles are substantially equally spaced around the rings. The six poles produce a magnetic field which tends to bend the two outer electron beams in the same direction while leaving the central electron beam substantially undisturbed. The direction of the beam bending can be varied by rotating the third beam adjusting assembly 16*c* about the axis of the supporing sleeve 18. This is accomplished by using the third adjusting shaft 34*c* as a handle to rotate the supporting ring 22*c* about the axis of the supporting sleeve 18. The magnitude of the beam bending can be adjusted by rotating the shaft 34*c* so as to rotate the magnet rings 24*c* and 26*c* in opposite directions. The maximum beam bending is achieved when like magnetic poles on the two rings 24*c* and 26*c* are aligned, north opposite north and south opposite south. The beam bending can be diminished by rotating the rings 24*c* and 26*c* toward the position of substantially zero beam bending, in which unlike magnetic poles are aligned, north opposite south and south opposite north, so that the magnetic fields of the two magnet rings 24*c* and 26*c* substantially neutralize each other.

The magnet rings 24*a, b, c* and 26*a, b, c* are made of a material which can be magnetized, and also can be molded to form the bevel gears 28*a, b, c* and 30*a, b, c.* For example, the magnet rings may be made of a mixture of a finely divided ferrite material and a moldable resinous plastic material. If desired, the ferrite material may constitute about 75% of the mixture, while the moldable resinous plastic material may constitute about 25% thereof. It will be understood that the proportions may be varied widely.

Figure 17:
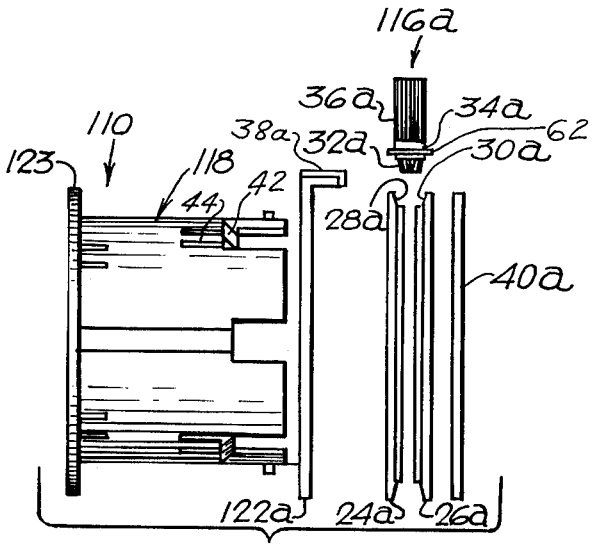
FIG. 17 is a fragmentary exploded elevation corresponding to the left-hand portion of FIG. 4, but showing a modified convergence device in which the supporting ring of the first beam adjusting assembly is rotatable about the supporting sleeve.
Figure 19:
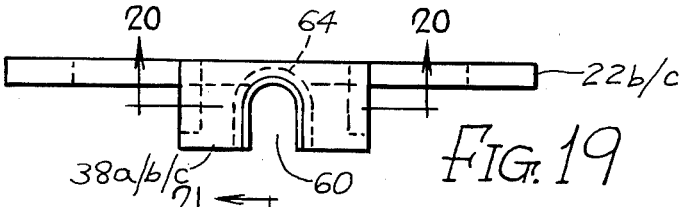
FIG. 19 is a top view, taken as indicated by the line 19—19 of FIG. 18.
Figure 18:
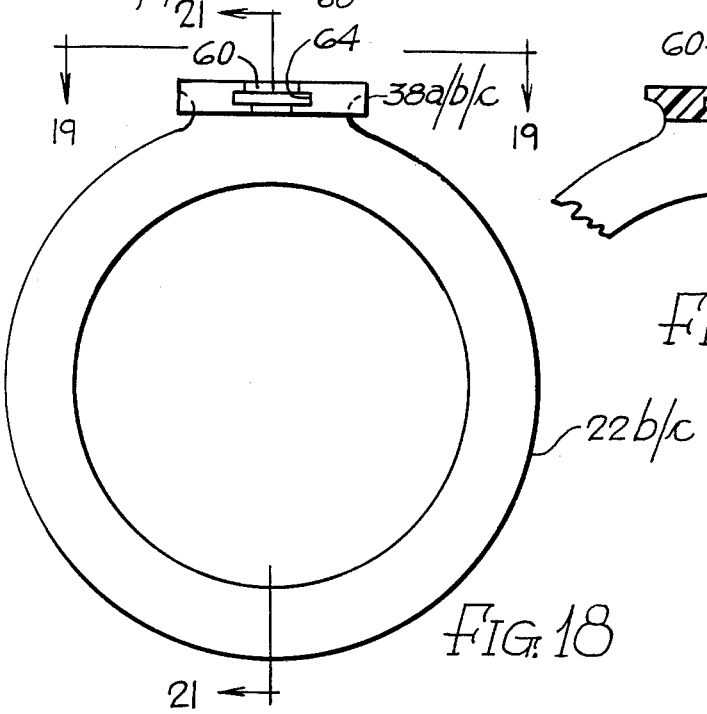
FIG. 18 is a right-hand end view of one of the rotatable supporting rings of FIGS. 4 and 17.
Figure 20:
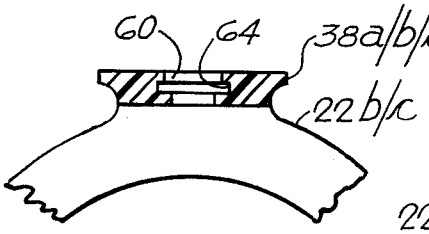
FIG. 20 is a fragmentary section, taken generally along the line 20—20 in FIG. 19.
Figure 21:
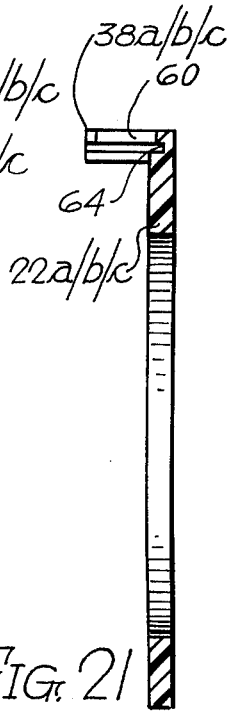
FIG. 21 is a section taken generally along the line 21—21 in FIG. 18.

FIG. 17 illustrates a modified convergence device 110, which is the same as the convergence device 10 of FIGS. 1–4, except that the first beam adjusting assembly 16*a* is replaced with a slightly modified beam adjusting assembly 116*a* having a supporting ring 122*a* which is rotatable about a modified supporting sleeve 118. The supporting ring 122*a* may be exactly the same as the supporting rings 22*b* and *c* of FIGS. 1–4. In the modified convergence device 110 of FIG. 17, the rotatable supporting ring 122*a* slideably engages an end flange 123 on the mounting sleeve 118. In FIG. 17, the magnet rings 24*a* and 26*a,* the bevel gears 28*a* and 30*a,* the bevel pinion 32*a,* the adjusting shaft 34*a,* the knob 36*a* and the supporting member 38*a* may be the same as described in connection with FIGS. 1–4. Moreover, all of the other components of the convergence device 110 may be the same as described in connection with FIGS. 1–4.

In the operation of the convergence device 110 of FIG 17, the entire first beam adjusting assembly 116*a* can be adjusted as to angular position by turning the assembly around the supporting sleeve 118. This is done by using the shaft 34*a* as a handle to rotate the supporting ring 122*a.* In this way, the direction of the magnetic field produced by the magnet rings 24*a* and 26*a* can be varied, so as to vary the direction in which the three electron beams are bent.

FIG. 4A illustrates a clamping or locking device 200 which is adapted to replace the retaining ring 42 of FIG. 4. Thus, the locking device 200 can easily be incorporated into the convergence device 10 of FIGS. 1–4. The clamping device 200 comprises a camming or operating ring 202 and a spring supporting ring 204. In this case, the ring 204 supports a plurality of bow springs 206 which are seated in recesses 208 formed in the ring 204. The bow springs 208 may be similar to the bow springs 46.

FIGS. 5–10A illustrate a modified convergence device 210 which incorporates the clamping device 200 of FIG. 4A. Otherwise, the convergence device 210 may be the same as the convergence device 10 of FIGS. 1–4, or the same as the modified convergence device 110 of FIG. 17.

As shown in FIG. 9, there are four of the bow springs 206 and four recesses 208. The operating ring 202 is formed with corresponding camming recesses 211 for receiving the bow springs 206.

The spring supporting ring 204 is retained on the supporting sleeve 18 by the barbs 42 formed on the spring fingers 44. Thus, the operating ring 202 and the spring supporting ring 204 are stacked on the supporting sleeve 18 to replace the retaining ring 42, which is not used.

The ends of the barbs 42 are also shown in FIG. 10, which is a right-hand end view of the convergence device 210. In this case, there are four of the barbs 42.

It will be seen from FIGS. 10 and 10A that the barbs 42 are adapted to snap into recesses 213 formed in the ring 204. Such recesses 213 are formed in the outer side of the ring 204, while the spring receiving recesses 208 are formed in the inner side thereof, with respect to the position of the ring 204 when it is assembled on the convergence device 210.

As shown in FIG. 10A, each recess 213 has a deep portion 215 at one end, a shallower portion 217 at the opposite end, and a ramp 219 therebetween. The four barbs 42 are snapped initially into the deep portions 215 of the corresponding recesses 213. The ring 204 is then rotated so that the barbs 42 ride up the ramps 219 into the shallower portions 217 of the recesses 213. This rotation of the ring 204 increases the compression of the bow springs 206 so that they exert a greater pressure upon the components of the beam adjusting devices 16*a, b* and *c.*

When the clamping device 200 is released, the operating ring 202 is in the position shown in FIGS. 5 and 6. The springs 206 are received in the recesses 211.

The clamping device 200 is actuated by turning the ring 202 through a small angle, such as about 30°. This is facilitated by providing an outwardly projecting handle 219*a* on the ring 202. The rotation of the ring 202 causes the springs 206 to ride up out of the recesses 211, so that the compression of the springs 206 is increased. In this way, the springs 206 exert sufficient pressure to maintain the beam adjusting devices 16*a,* 16*b* and 16*c* in their adjusted positions. The locking device 200 is shown in its actuated position in FIGS. 7 and 8.

It will be understood that the recesses 213 in the retaining ring 204 constitute additional camming means for initially compressing the springs 206. The ramps 219 act as camming elements which are engaged and followed by the barbs 42.

The operating ring 202 produces additional compression of the bow springs 206 when the operating ring 202 is rotated so as to cause the springs to ride up and out of the camming recesses 211.

As shown in FIGS. 9 and 9A, the bow springs 206 are retained in the recesses 208 by tabs or flanges 223. Each tab 223 projects into and overhangs one end portion of the corresponding recess. Each bow spring 206 has flat end portions 225, one of which is retained under the corresponding tab 223.

I claim:

1. A convergence device for television picture tubes,
comprising a mounting sleeve having an axial opening for receiving the neck of a television picture tube,
at least one supporting ring rotatably mounted around said mounting sleeve for rotary adjustment relative thereto,
a pair of magnet rings rotatably mounted around said mounting sleeve and stacked upon said supporting ring,
said magnet rings having respective bevel gears formed in one piece with said magnet rings and facing toward each other,
a rotatable generally radial adjusting shaft having a bevel pinion meshing with and disposed between said bevel gears on said magnet rings,
and a member on said supporting ring supporting said shaft for rotation about a radial axis relative to the axis of the mounting sleeve,
said shaft being rotatable to cause rotation of said magnet rings in opposite directions about the axis of said mounting sleeve,
said supporting ring along with said shaft and said magnet rings being rotatable in common about the axis of said supporting sleeve,
said shaft constituting a handle for the rotary adjustment of the assembly comprising said supporting ring and said magnet rings relative to said mounting sleeve.

2. A device according to claim 1, in which said member on said supporting ring is formed with a bearing seat for rotatably receiving said shaft,
said seat having an open side facing away from said supporting ring and in a direction generally parallel to the axis of said mounting sleeve,
said bevel pinion on said shaft being held captive between said bevel gears on said magnet rings whereby said shaft is retained in said seat,
and retaining means including a retaining ring mounted around said mounting sleeve for maintaining said magnet rings in a stacked relation to said supporting ring.

3. A device according to claim 1,
including at least one additional adjusting assembly comprising a second supporting ring rotatably mounted around said mounting sleeve for rotary adjustment relative thereto,
a second pair of magnet rings stacked upon said second supporting sleeve and having respective bevel gears formed in one piece with said magnet rings,
a second generally radial shaft having a bevel pinion meshing with said bevel gears,
and a member on said supporting ring and rotatably supporting said shaft,
said second supporting ring, said second magnet rings, and said second shaft being constructed and arranged substantially the same as the supporting ring, the magnet rings and the shaft mentioned in claim 1.

4. A device according to claim 1,
in which said mounting sleeve is formed with an outwardly projecting ring-shaped flange,
said device including an additional pair of magnet rings rotatably mounted around said sleeve and stacked upon said flange,
said additional magnet rings having respective bevel gears formed in one piece with said additional magnet rings and facing toward each other,
an additional rotatable shaft having a bevel pinion meshing with said bevel gears,
and an additional member on said flange and rotatably supporting said shaft for rotation about a radial axis relative to the axis of said mounting sleeve.

5. A convergence device for television picture tubes,
comprising a mounting sleeve having an axial opening for receiving the neck of a television picture tube,
three beam adjusting assemblies supported on said mounting sleeve,
each of said beam adjusting assemblies including a supporting ring member projecting outwardly from said mounting sleeve,
a pair of magnet rings rotatably mounted around said mounting sleeve and stacked upon said supporting ring member,
said magnet rings having respective bevel gears formed in one piece with said magnet rings and facing toward each other,
a rotatable generally radial adjusting shaft having a bevel pinion meshing with and disposed between said bevel gears on said magnet rings,
and shaft supporting means on said supporting ring member and supporting said shaft for rotation about a generally radial axis relative to the axis of the mounting sleeve,
said shaft being rotatable to cause rotation of said magnet rings in opposite directions about the axis of said mounting sleeve,
each of said magnet rings being formed with a plurality of magnetic poles,
at least two of said beam adjusting assemblies being rotatable about said supporting sleeve for rotary adjustment relative thereto with the aid of said shafts constituting handles for accomplishing said rotary adjustment,
and retaining means including a retaining ring mounted on said mounting sleeve for retaining said beam adjusting assemblies in stacked relation on said mounting sleeve.

6. A device according to claim 5,
in which all three of said beam adjusting assemblies are rotatable about said mounting sleeve.

7. A device according to claim 5, in which each shaft supporting means includes a generally U-shaped bearing seat on the corresponding supporting ring.

8. A device according to claim 7,
including flange means for retaining each shaft in the corresponding bearing seat.

9. A device according to claim 7,
including flange means on each shaft for retaining said shaft in the corresponding bearing seat,
each bearing seat having a groove for receiving said flange means.

10. A convergence device for television picture tubes, comprising a mounting sleeve having an axial opening for receiving the neck of a television picture tube, three beam adjusting assemblies supported on said mounting sleeve, each of said beam adjusting assemblies including a supporting ring member projecting outwardly from said mounting sleeve, a pair of magnet rings rotatably mounted around said mounting sleeve and stacked upon said supporting ring member, said magnet rings having respective bevel gears formed in one piece with said magnet rings and facing toward each other, a rotatable generally radial adjusting shaft having a bevel pinion meshing with and disposed between said bevel gears on said magnet rings, and shaft supprting means on said supporting ring member and supporting said shaft for rotation about a generally radial axis relative to the axis of the mounting sleeve, said shaft being rotatable to cause rotation of said magnet rings in opposite directions about the axis of said mounting sleeve, each of said magnet rings being formed with a plurality of magnetic poles, at least two of said beam adjusting assemblies being rotatable about said supporting sleeve, and retaining means for retaining said beam adjusting assemblies in stacked relation on said mounting sleeve, said magnet rings being made of a magnetizable moldable material comprising a mixture of a finely divided ferrite material and a moldable resinous plastic material.

11. A device according to claim 10, in which said mixture consists of substantially 75% of the finely divided ferrite material and 25% of the moldable resinous plastic material.

12. A convergence device for television picture tubes, comprising a mounting sleeve having an axial opening for receiving the neck of a television picture tube, at least one supporting ring rotatably mounted around said mounting sleeve for rotary adjustment relative thereto, a pair of magnet rings rotatably mounted around said mounting sleeve and stacked upon said supporting ring, said magnet rings having respective bevel gears formed in one piece with said magnet rings and facing toward each other, a rotatable generally radial adjusting shaft having a bevel pinion meshing with and disposed between said bevel gears on said magnet rings, and a member on said supporting ring supporting said shaft for rotation about a radial axis relative to the axis of the mounting sleeve, said shaft being rotatable to cause rotation of said magnet rings in opposite directions about the axis of said mounting sleeve, said supporting ring along with said shaft and said magnet rings being rotatable in common about the axis of said supporting sleeve, said magnet rings being made of a magnetizable moldable material comprising a mixture of a finely divided ferrite material and a moldable resinous plastic material.

13. A device according to claim 12, in which said mixture consists of substantially 75% of the finely divided ferrite material and 25% of the moldable resinous plastic material.

14. A convergence device for television picture tubes, comprising a mounting sleeve having an axial opening for receiving the neck of a television picture tube, a pair of magnet rings rotatably mounted around said mounting sleeve, said magnet rings having respective gears formed in one piece with said magnet rings and facing toward each other, a rotatable generally radial adjusting shaft having a pinion meshing with and disposed between said gears on said magnet rings, and means supporting said shaft for rotation about a radial axis relative to the axis of said mounting sleeve, said shaft being rotatable to cause rotation of said magnet rings in opposite directions about the axis of said mounting sleeve, said magnet rings being made of a magnetizable moldable material comprising a mixture of a finely divided ferrite material and a moldable resinous plastic material.

15. A device according to claim 14, in which said mixture consists of substantially 75% of the finely divided ferrite material and 25% of the moldable resinous plastic material.

16. A convergence device for television picture tubes, comprising a mounting sleeve having an axial opening for receiving the neck of a television picture tube, at least one supporting ring rotatably mounted around said mounting sleeve for rotary adjustment relative thereto, a pair of magnet rings rotatably mounted around said mounting sleeve and stacked upon said supporting ring, said magnet rings having respective bevel gears formed in one piece with said magnet rings and facing toward each other, a rotatable generally radial adjusting shaft having a bevel pinion meshing with and disposed between said bevel gears on said magnet rings, and a shaft supporting member on said supporting ring and supporting said shaft for rotation about a radial axis relative to the axis of the mounting sleeve, said shaft being rotatable to cause rotation of said magnet rings in opposite directions about the axis of said mounting sleeve, said supporting ring along with said shaft and said magnet rings being rotatable in common about the axis of said supporting sleeve, said shaft supporting member being disposed radially outwardly from said magnet rings, said magnet rings having outwardly projecting stops projecting radially therefrom and engagable with said shaft supporting member for limiting the rotation of said magnet rings relative to said supporting ring by the rotation of said adjusting shaft.

17. A convergence device for television picture tubes, comprising a mounting sleeve having an axial opening for receiving the neck of a television picture tube, at least one supporting ring member mounted around said mounting sleeve, a pair of magnet rings rotatably mounted around said mounting sleeve and stacked upon said supporting ring member, said magnet rings having respective bevel gears formed in one piece with said magnet rings and facing toward each other, a rotatable generally radial adjusting shaft having a bevel pinion meshing with and disposed between said bevel gears on said magnet rings, and a shaft supporting member on said supporting ring member and supporting said shaft for rotation about a radial axis relative to the axis of the mounting sleeve, said shaft being rotatable to cause rotation of said magnet rings in opposite directions about the axis of said mounting sleeve, said shaft supporting member being disposed radially outwardly from said magnet rings, said magnet rings having outwardly projecting stops projecting radially therefrom and engageable with said shaft supporting member for limiting the rotation of said magnet rings relative to said supporting ring member by the rotation of said adjusting shaft.

* * * * *

UNITED STATES PATENT OFFICE

CERTIFICATE OF CORRECTION

Patent No. 4,050,042 Dated September 20, 1977

Inventor(s) Albert M. Anthony

It is certified that error appears in the above-identified patent and that said Letters Patent are hereby corrected as shown below:

Column 4, line 37, "product" should be --produce--

Signed and Sealed this

*Twenty-seventh* Day of *December 1977*

[SEAL]

*Attest:*

RUTH C. MASON
*Attesting Officer*

LUTRELLE F. PARKER
*Acting Commissioner of Patents and Trademarks*

Dedication 4,050,042.—*Albert M. Anthony,* Bangor, Mich. STATIC CONVERGENCE DEVICES FOR COLOR TELEVISION PICTURE TUBES. Patent dated Sept. 20, 1977. Dedication filed May 7, 1980, by the assignee, *Tractor, Inc.*

Hereby dedicates the entire term of said patent to the Public.

[*Official Gazette October 14, 1986.*]